US007077732B2

(12) United States Patent
Dodds

(10) Patent No.: US 7,077,732 B2
(45) Date of Patent: Jul. 18, 2006

(54) HIGH TORQUE DUAL CHAMBER TURBINE ROTOR FOR HAND HELD OR SPINDLE MOUNTED PNEUMATIC TOOL

(75) Inventor: Kemma S. Dodds, North Lauderdale, FL (US)

(73) Assignee: Air Turbine Technology, Inc., Boca Raton, FL (US)

( * ) Notice: Subject to any disclaimer, the term of this patent is extended or adjusted under 35 U.S.C. 154(b) by 103 days.

(21) Appl. No.: 10/051,607

(22) Filed: Jan. 17, 2002

(65) Prior Publication Data

US 2005/0064803 A1 Mar. 24, 2005

(51) Int. Cl.
*B24B 5/00* (2006.01)

(52) U.S. Cl. ..... 451/295; 451/344; 415/355

(58) Field of Classification Search ..... 451/344, 451/295; 415/35, 199, 202, 904, 355
See application file for complete search history.

(56) References Cited

U.S. PATENT DOCUMENTS 188,979 A * 3/1877 Strand ..... 415/82
753,735 A 3/1904 Prescott
3,128,079 A * 4/1964 De Groff ..... 415/123
3,709,630 A * 1/1973 Pohl et al. ..... 415/199.5
3,918,248 A * 11/1975 Suzuki ..... 57/101
4,087,198 A 5/1978 Theis, Jr.
4,776,752 A * 10/1988 Davis ..... 415/25
5,261,233 A 11/1993 Kishi
5,290,107 A * 3/1994 Hanaway ..... 384/49
5,364,227 A * 11/1994 Franetzki et al. ..... 415/35
5,439,346 A * 8/1995 Bowser et al. ..... 415/18
5,499,940 A * 3/1996 Johnson et al. ..... 446/180
5,819,717 A * 10/1998 Johnson et al. ..... 124/65
6,134,746 A * 10/2000 Miller et al. ..... 15/387

* cited by examiner

*Primary Examiner*—Lee D. Wilson
*Assistant Examiner*—Alvin J Grant
(74) *Attorney, Agent, or Firm*—Wildman, Harrold, Allen & Dixon LLP

(57) ABSTRACT

A high torque turbine rotor for a lightweight hand held tool for grinding and polishing having a rotor that includes two separate high pressure air chambers separated by a common housing wall, each air chamber having peripheral air expelling nozzles in a tangential direction to the rotor periphery. The rotor housing is lightweight and increases torque without generally increasing the overall size and weight of the tool housing.

32 Claims, 3 Drawing Sheets

HIGH TORQUE DUAL CHAMBER TURBINE ROTOR FOR HAND HELD OR SPINDLE MOUNTED PNEUMATIC TOOL

BACKGROUND OF THE INVENTION

1. Field of the Invention

This invention relates to a pneumatically powered, hand held or spindle-mounted lightweight tool suitable for grinding and polishing and, more particularly, to a turbine rotor for a lightweight, grinding tool driven by an air-powered reaction turbine. The turbine rotor creates high torque for a drive shaft without a significant increase in size or weight of the grinding tool.

2. Description of Related Art

In the prior art, lightweight pneumatic tools have been used for a variety of functions, such as grinding, polishing, metal or plastic finishing, engraving, drilling, and deburring. The tool variations include hand-held and machine spindle-mounted embodiments. Hand-held tools often include a narrow cylindrical exterior housing that includes a handle portion enclosing the rotor and a drive shaft that is held much like a pencil or pen. Lightweight pneumatic grinding tools can be hand held for longer periods of time than a comparable electric motor tool which is much heavier without harm to the user.

Prior art pneumatically-powered tools utilize either a vane-type fluid motor or a reactive rotor. The present invention does not employ a vane-type motor but utilizes a reactive rotor. The reactive rotor expels high pressure, high velocity air tangentially from the rotor peripherally to obtain torque. The rotor is coupled to the primary drive shaft therein.

U.S. Pat. No. 5,566,770, which has a common assignee with the present invention, provides an angled spindle that is relatively lightweight driven by a single chamber rotor. U.S. Pat. No. 4,776,752, which also has a common assignee with the present invention, teaches a single chamber turbine rotor that is relatively lightweight and includes a high-speed governor.

Although the torque provided in current turbine rotors is adequate for grinding and polishing tools that are lightweight and compact, higher torque in some applications of grinding and polishing is desirable. However, enlarging the tool rotor (and therefore the housing) to increase torque could greatly increase the weight, size and volume of the tool housing and therefore reduce the hand-held, lightweight advantages of the tool.

The present invention increases the torque of a rotor driven pneumatic tool significantly without concomitant increases in weight, size or complexity of operation or manufacture of the tool. In fact, an increase in torque becomes possible with a decrease in diameter of the tool. For example, where a rotor approximately one inch in diameter would provide approximately 0.2 horsepower at 50,000 revolutions per minute ("RPMs"), with the present invention a rotor of only ¾ inch in diameter provides approximately 0.3 horsepower at 50,000 RPMs. In addition to an increase in power, the present invention provides for a slimmer tool profile. Moreover, the present invention also reduces the pressure that is necessary to idle the rotor in comparison to a single rotor of comparable size and material from three cubic feet per minute for the one inch single rotor to two cubic feet per minute for a ¾ inch dual rotor.

The present invention uses a rotor comprising a single, compact body having dual, high pressure air receiving chambers that share a common wall, to reduce size and weight for increased torque. Both rotor body chambers have tangential exhaust nozzles that generate torque to rotate the rotor. The present invention may also include dual automatic speed governors without additional complexity.

A lightweight tool is also desirable in a spindle mount since the tool is supported on a moveable arm.

BRIEF SUMMARY OF THE INVENTION

A high-torque turbine rotor mounted in a hand-held or spindle mounted pneumatic tool narrow housing on a drive shaft. The rotor body has a threaded central aperture that receives and is fixedly attached to the threaded drive shaft. The rigid drive shaft is partially hollow and has two pairs of openings that serve as inlets to the rotor body for high-pressure air that provides the motive force on the rotor body for turning the drive shaft. A grinder member for grinding is affixed to one end of the drive shaft. The opposite end is attached to a flexible air hose or high-pressure air supply.

The cylindrical rotor body has a rigid cylindrical outer wall and an inner central wall dividing the rotor body into two separate compartments, with an open front and an open back. The cylindrical rotor body has a first annular chamber, a second annular chamber, and a common inner wall. A front wall and a back wall are connected to the rotor cylindrical wall forming two separate air receiving chambers.

The front, back and inner rotor walls each have a threaded aperture for attachment to the threaded drive shaft. The rotor cylindrical body and the front, inner and back walls provide two separate chambers in the rotor, a first annular chamber and a second annular chamber. The rotor cylindrical wall has a plurality of tangentially directed passages strategically spaced to direct high pressure internal air outwardly, resulting in torque on the rotor and thus, the shaft.

In the preferred embodiment, each rotor chamber in the rotor body receives high pressure air from the drive shaft inlets. Each rotor body chamber has a cylindrical interior shape and includes four separate tangential air passages that exhaust high-pressure air tangentially and peripherally, causing a reactive force as the air is expelled from both chambers. The inside peripheral wall of each chamber has four tapered portions proceeding from a narrow portion to a thicker portion, the thicker portion accommodating the four tangential exhaust air passages. The housing tangential air exhaust passages are spaced approximately 90 degrees apart around the annular chamber. In the preferred embodiment, there are two separate chambers separated by the common inner wall, each of which has four separate exhaust passages that are peripheral and tangential. Thus, for each rotor body there are eight separate exhaust passages. The use of eight separate passages greatly increases torque for a single rotor.

In the preferred embodiment each rotor body chamber (the first chamber and second chamber) includes a governor to limit the overall RPM of the rotor and therefore the shaft as described in U.S. Pat. No. 4,776,752. The governor and each chamber described in the '752 patent includes an annular perforated barrier and a resilient o-ring that fits on the inside of the annular perforated barrier. The rotor chamber walls include annular grooves for retaining the annular perforated barrier. As the RPMs of the rotor increase, the resilient o-ring expands under centrifugal force outwardly, resiliently engaging the annular perforated barrier, thereby shutting off air under pressure from the air inlet to the peripheral exhaust nozzles to regulate the amount force and therefore the RPMs of the rotor.

There are various types of turbine rotors available. However, to increase the amount of torque obtained in a current rotor, the turbine rotor housing would have to be enlarged, causing a larger housing, increased weight and possible vibration, chatter and increased wear on the turbine parts and operator fatigue.

It is an object of the present invention to provide a lightweight pneumatic grinding tool that is able to maintain a constant rotational speed when subjected to a load without producing unwanted vibration, which also provides increased torque while retaining a narrow tool housing for comfortable holding during use.

It is also an object of the present invention to provide a lightweight grinding tool having a reaction rotor that generates high torque at a relative small size and weight.

It is still another object of the present invention to provide a turbine rotor for the drive shaft of a tool as aforementioned which is relatively lightweight and compact and which produces a significant increase in torque over that of the prior art.

In accordance with these and other objects which will become apparent hereinafter, the instant invention will now be described with particular reference to the accompanying drawings.

DETAILED DESCRIPTION OF THE INVENTION

Figure 1A:
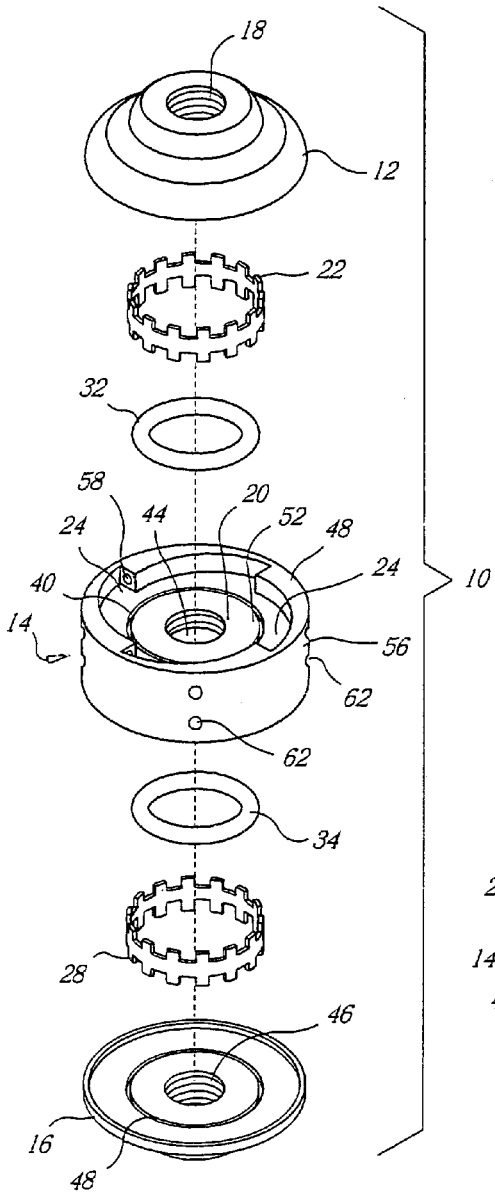
FIG. 1A is an exploded, perspective view of the preferred embodiment of the invention.
Figure 1B:
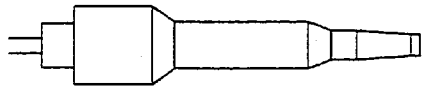
FIG. 1B is a side elevational view of an alternative embodiment of the invention.

Referring now to the drawings, in particular FIGS. 1A through 4, the instant turbine rotor is illustrated generally at 10. An outside elongated tool housing that is hand-held and that encloses the rotor, shaft and bearings is shown in FIG. 1B. The turbine rotor 10 is used in a hand held or spindle mounted tool as shown in FIG. 1B, suitable for work such as grinding and polishing.

The turbine rotor body 10 preferably has two separate internal high pressure air receiving chambers (a first chamber and a second chamber), formed by a front wall 12, a middle inner wall 14 and a back wall 16. The rotor body 10 is generally cylindrical. The front wall 12 and the back wall 16 may be identical. The front wall 12, inner wall 14 and back wall 16 fit together frictionally and are generally air tight. For example, the front wall 12 and the back wall 16 each has a peripheral flange which engages and extends over the edge of the periphery of the chamber walls of the middle wall 14. In the preferred embodiment, the front wall 12 and the back wall 16 are press fit against the middle wall 14. However, the front wall 12 and the back wall 16 and the inner wall 14 may also be glued together or releasably or permanently attached by other, equivalent elements such as a metal clip.

Figure 2:
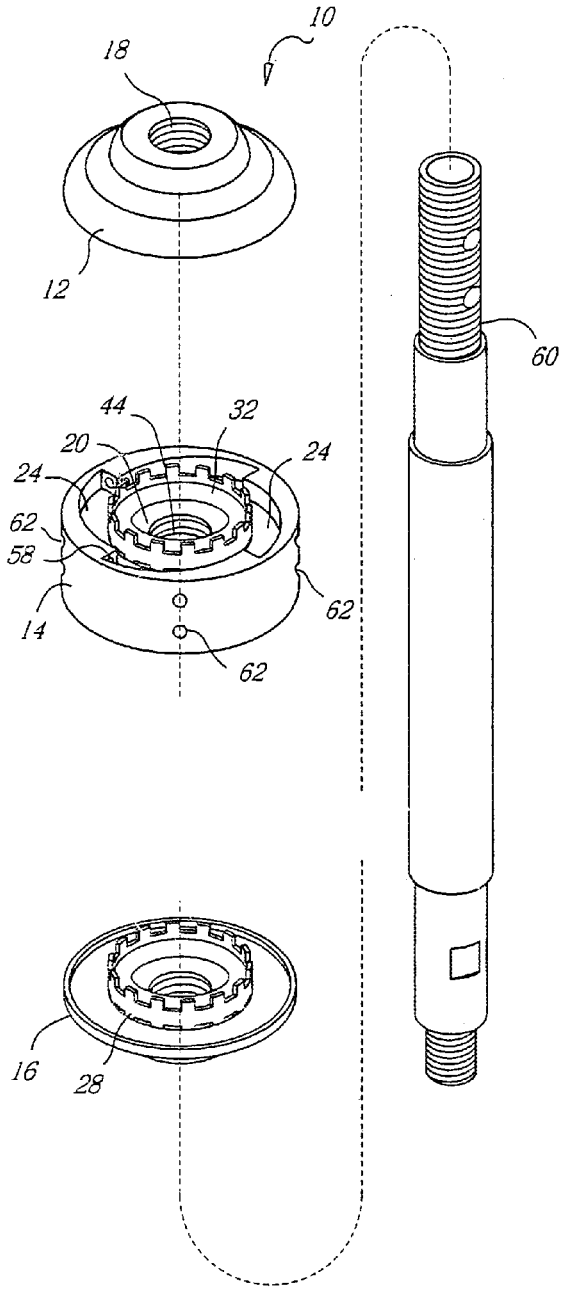
FIG. 2 is a cross-sectional, side elevational view of the preferred embodiment of the invention.
Figure 4:
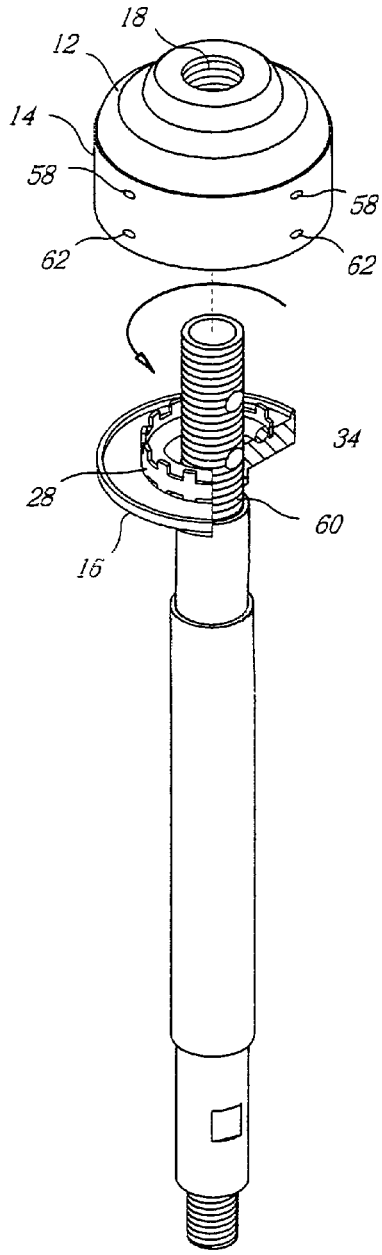
FIG. 4 is a partially exploded, sectional perspective view of the preferred embodiment.
Figure 5:
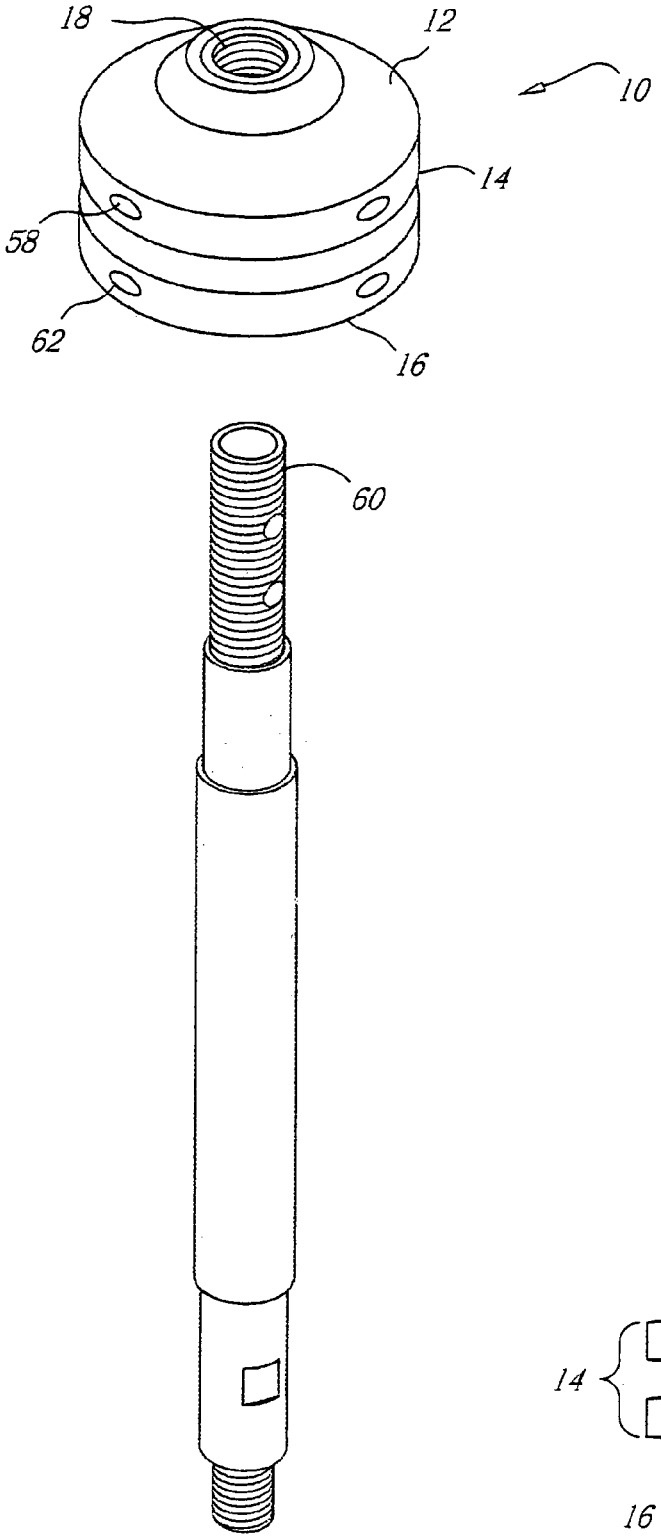
FIG. 5 is a perspective view of an alternative embodiment.

The front wall 12 includes a central threaded bore 18. In the preferred embodiment, the bore 18 is threaded to correspond with threads on a drive shaft 60, as shown in FIGS. 2, 4 and 5. The drive shaft 60 comprises hollow openings that serve as inlets for high pressure air to enter the rotor body 10 chambers to propel the rotor body 10. Other forms of attachment with the drive shaft 60, both releasable and permanent, are contemplated, such as gluing, welding or frictional engagement with the drive shaft 60. The front wall 12 and the back wall 16 may be made of plastic, metal or other suitable lightweight, rigid material that can be generally airtight. When the rotor body is engaged with the shaft, torque produced on the rotor is transferred to the shaft, causing the shaft to rotate.

The common inner wall 14 may also be made from plastic, metal or other suitable material. The inner wall 14 includes a threaded central bore 44 to correspond with threads on the drive-shaft 60 of the tool.

The rotor body 10 in the preferred embodiment includes a governor in each rotor housing chamber as described in the '752 patent. Preferably, the governor comprises a first annular chamber area 20 on the front surface 48 of the inner wall 14. Extending from the outer portion 52 of the first annular chamber 20 is at least one first arcuate chamber 24. As show in FIGS. 1 through 4, in the preferred embodiment, four (4) first arcuate chambers 24 are provided which extend from the outer portion 52 of the first annular chamber 20 to the circumference 56 of the inner wall 14. The arcuate chambers 24 open to first circumferential openings 58.

A first resilient valve o-ring 32 is mounted in the first annular chamber 20 to regulate and restrict the flow of the air from the first annular chamber 20 to the first arcuate chamber 24. Extending away from the first valve o-ring 32 is an annular first perforated barrier 22. When high pressure air (approximately 90 psi) is introduced into the rotor body 10, and the rotor speed reaches a predetermined number of revolutions per minute, the valve o-ring 32 deforms against the perforated barrier 22, thereby restricting air flow and decreasing the RPMs of the rotor.

Figure 3A:
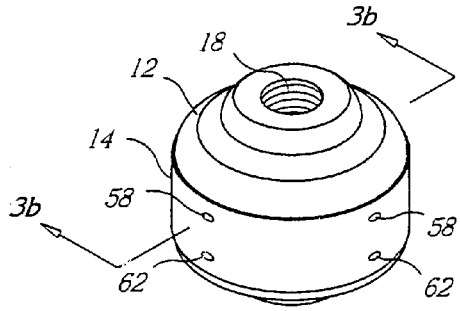
FIG. 3A is a perspective view of the preferred invention.
Figure 3B:
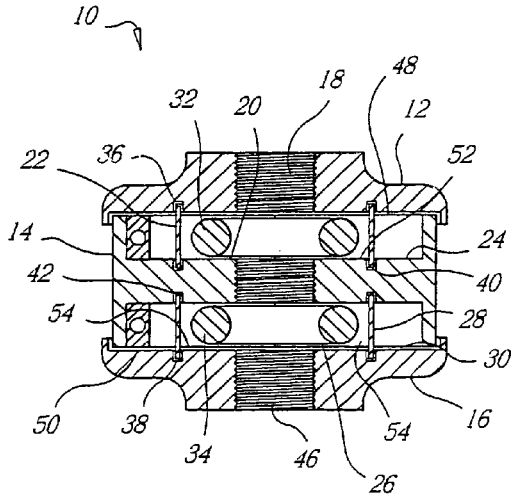
FIG. 3B is a cross-sectional side elevation view of the preferred invention.

As shown in FIG. 3, the rotor body 10 includes a second annular chamber 26 on the rear surface 50 of the inner wall 14. Extending from the outer portion 54 of the second annular chamber 26 is at least one second arcuate chamber 30. In the preferred embodiment, four (4) second arcuate chambers 30 (90 degrees apart) are provided which extend from the outer portion 54 of the second annular chamber 26 to the circumference 56 of the rotor body 10. The second arcuate chamber 30 opens to second circumferential openings 62. As illustrated in FIGS. 1 and 2, the first arcuate chambers 24 and the second arcuate chambers 30 are aligned, as are the first and second circumferential openings 58,62. The air passages openings 58,62 are directionally tangential to the cylindrical rotor body 10 and expel high pressure air tangentially to provide force to rotate the rotor body 10. However, the alignment of the openings 58,62 is not necessary for operation of the invention.

The second annular chamber 26 also contains a second resilient valve o-ring 34 to regulate and restrict the flow of the air from the second annular chamber 26 to the second arcuate chamber 30. Located radially away from the second valve o-ring 34 is an annular second perforated barrier 28. Thus, when the air is introduced into the turbine rotor 10 and the rotor reaches a predetermined RPM speed, the second resilient valve ring 34 deforms against the perforated barrier 28 as the rotor spins, thereby restricting air flow and slowing down the rotor.

The valve o-rings 32, 34 are generally resilient and are made of rubber. The entire turbine rotor 10 (except for the valve o-rings) may be made of rigid plastic materials. The turbine rotor 10 bearings do not need lubrication. The perforated barriers 22, 28 may be made of plastic, metal or other suitable material. Also the perforated barriers 22,28 may be formed intrinsically with the inner wall 14, or releasably or permanently attached to the front surface 48 and the rear surface 50 of the inner wall 14. The perforated barriers 22,28 may be a fence-like structure as illustrated in FIG. 1. However, equivalent structures are also contemplated.

Also in the preferred embodiment, a groove 36 in the front wall 12 and a corresponding groove 40 in the front surface of the inner wall 14 are situated so the first perforated barrier 22 is aligned properly within the turbine rotor body 10. Similarly a groove 38 in the back wall 16 and a corresponding groove 42 in the rear surface 50 of the inner wall 14 are situated so the second perforated barrier 28 is aligned properly in the turbine rotor body 10. A single groove may also be used to properly align the perforated barrier.

In operation, the preferred embodiment of the turbine rotor 10 works as follows. Air under pressure (approximately 90 psi) enters the turbine rotor 10 from the drive shaft 60 into the central bores 18,44,46 in the front wall 12, inner wall 14 and back wall 16. The air under pressure enters the first and second annular chambers 20,26 and travels around the first and second valve o-rings 32,34 through the first and second perforated barriers 22,28 into the first and second arcuate chambers 24,30. The air then is forced under pressure from the arcuate chambers 24,30 through circumferential openings 58, 62 in the circumference 56 of the inner wall 14. These peripheral openings operate as tangential nozzles, providing air streams generating torquing force to rotate the turbine. The reactive force of the air causes the turbine rotor 10 to rotate.

The preferred embodiment includes a revolutions per minute ("RPM") governor described in U.S. Pat. No. 4,776,752 in each drive chamber. The resilient deformation of the valve o-rings 32,34 against the perforated barriers 22,28 caused by centrifugal force forces the turbine 10 to turn at a predetermined, somewhat constant rate. As the turbine rotor 10 rotates at a high RPM speed, the first and second valve o-rings 32,34 deform, pressing against the perforations of the first and second perforated barriers 22,28. The deformation of the valve o-rings 32,34 restricts air flow through the perforations in the barriers 22,28, thereby reducing rotational forces. Eventually equilibrium is reached whereby a constant speed of rotation for the turbine rotor 10 is achieved.

The torque of the turbine rotor 10 in the present invention is greatly increased over that of prior art rotors. For example, when compared to two stacked turbine rotors, the present invention provides less weight, vibration, chatter and run-through of the air and fewer moving parts that may wear.

Figure 6:
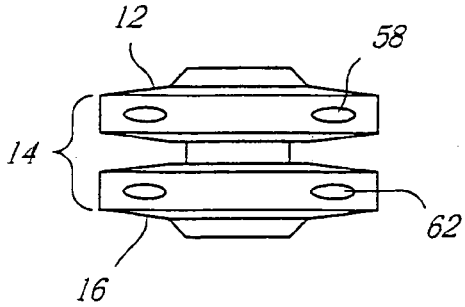
FIG. 6 is a side elevation view of an alternative embodiment of the invention.

FIGS. 5 and 6 illustrate an alternative embodiment of the invention. As shown in FIGS. 5 and 6 the rotor housing is narrowed, for less weight and a further increase in torque.

The design of the turbine rotor 10 with multiple annular chambers and multiple arcuate chambers provides an increase in torque from prior art air turbines without a significant increase in the weight of the spindle apparatus. Moreover, there is less vibration than would be if single turbine rotors were stacked on top of each other. It is also contemplated in an alternative embodiment that additional annular chambers and arcuate chambers could be formed between in the first and second chambers. These additional chambers may have valve o-rings and perforated barriers as described herein for governing the RPMs. Furthermore, although the invention has been described to work with air, other gases are also contemplated for other applications.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A high torque turbine rotor for a hand held or spindle mounted pneumatic tool, comprising:

a rotor body having an inlet attachable to a high pressure air source, including:

a first annular chamber;

a second annular chamber; and a common inner wall, wherein said first annular chamber and said second annular chamber are separated by said common inner wall;

said rotor body being cylindrical and including a plurality of tangential peripheral nozzles in fluid communication with said first chamber and said second chamber for expelling high pressure air to rotate said rotor body;

said inner wall including a central bore for receiving an attachment to a drive shaft.

2. The high torque turbine rotor of claim 1, wherein said rotor further comprises:

an RPM governor in said first chamber and in said second chamber.

3. The high torque turbine rotor of claim 2, wherein said RPM governor includes:

a front wall;

at least one spiraling wall barrier extending from the outer portion of each annular chamber;

a valve o-ring within each annular chamber;

an annular perforated barrier within each annular chamber extending outward from the valve o-ring; and a back wall.

4. The high torque turbine rotor of claim 3, wherein each perforated barrier is integral with the rotor body of the rotor.

5. The high torque turbine rotor of claim 1, wherein four arcuate chambers radiate from each annular chamber.

6. The high torque turbine rotor of claim 3, wherein the front wall and a front interior surface of the inner wall are grooved for fitting a first perforated barrier, and the back wall and a back interior surface of the inner wall are grooved for fitting a second perforated barrier.

7. The high torque turbine rotor of claim 3, wherein the valve o-ring is resilient rubber.

8. The high torque turbine rotor of claim 3, wherein the common inner wall comprises:

one or more additional annular chambers and additional spiraling wall barriers located between the two annular chambers and the two spiraling wall barriers, an additional annular perforated barrier located within each additional annular chamber and located radially outward from an additional valve o-ring, and said additional valve o-ring located radially inward from the additional annular perforated barrier.

9. The high torque turbine rotor of claim 1, wherein the inner wall comprises a narrow waist.

10. The high torque turbine rotor of claim 3, wherein the components except for the valve o-ring are made of plastic.

11. The high torque turbine rotor of claim 3, wherein the front wall and the back wall are releasably attached to the inner wall.

12. The high torque turbine rotor of claim 11, wherein the front wall and the back wall are attached to the inner wall by frictional force.

13. The high torque turbine rotor of claim 1, wherein the plurality of tangential peripheral nozzles in communication with the first annular chamber are aligned with the plurality of tangential peripheral nozzles in communication with the second annular chamber.

14. A rotor body to a high torque turbine rotor, comprising:

a rotor body including a central bore, and said rotor body having a cylindrical outer wall and a central inner wall;

a front surface, including at least one first annular channel ending in at least one first arcuate channel ending in at least one first circumferential opening;

said first annular channel having a first groove for fitting a first perforated barrier and said second annular channel having a second groove for fitting a second perforated barrier; and a back surface, including at least one second annular channel ending in at least one second arcuate channel ending in at least one second circumferential opening.

15. The rotor body of claim 14, further comprising:

the first perforated barrier;

the second perforated barrier;

a first valve o-ring located between the first perforated barrier and the central bore; and a second valve o-ring located between the second perforated barrier and the central bore.

16. A hand held pneumatic tool, comprising:

a high torque turbine rotor body located circumferentially around a primary shaft, wherein the turbine rotor body includes:

a front wall and a back wall adapted for fitting with an inner wall, each including:

a central bore;

the inner wall adapted for fitting with the front wall and the back wall, the inner wall including:

at least two annular chambers;

at least one arcuate chamber radiating from the outer portion of each annular chamber;

a valve o-ring within each annular chamber;

an annular perforated barrier within each annular chamber located radially outward from the valve o-ring, and a central bore.

17. A hand held pneumatic tool, comprising:

a high torque turbine rotor having an outer wall and an axis of rotation, means for mounting said turbine rotor for rotation about said axis of rotation on a drive shaft, said turbine rotor having an inner wall and at least two high pressure air receiving chambers, means for directing pressurized air into the two chambers, said turbine rotor having an air passage in each chamber, said air passage ending in tangential nozzles in said outer wall of the rotor, said nozzles directing a pressurized fluid therefrom to impart rotation to said turbine rotor.

18. The hand held pneumatic tool of claim 17, wherein said rotor body includes a chamber wall separating said two chambers.

19. The hand held pneumatic tool of claim 17, further comprising a resilient sealing means located in each said annular chamber means;

said resilient sealing means being movable outwardly by centrifugal force to restrict pressurized flow through perforated barrier means, allowing pressurized fluid to flow unrestricted by said resilient sealing means until said resilient sealing means has been moved outwardly by centrifugal force to restrict pressurized flow through the perforated barrier means.

20. A high torque turbine rotor for a hand held or spindle mounted pneumatic tool, comprising:

means for generating torque with a cylindrical body having an inlet attachable to a high pressure air source, including:

means for generating torque in a first chamber of said body;

means for generating torque in a second chamber of said body;

means for directing pressurized air into the two chambers;

means for separating said first chamber from said second chamber; and means connecting said torque generating means to a shaft.

21. The high torque turbine rotor of claim 20, wherein said rotor further comprises means for governing the revolutions per minute of the rotor disposed within said first means for generating torque and said second means for generating torque.

22. A high torque turbine rotor for a hand held or spindle mounted pneumatic tool, comprising:

an inlet attachable to a high pressure air source;

a first annular chamber;

a first plurality of tangential peripheral nozzles in communication with said first annular chamber;

a second annular chamber;

a second plurality of tangential peripheral nozzles in communication with the second annular chamber; and a common inner wall including a central bore for receiving and attachment to a drive shaft, wherein said first annular chamber and said second annular chamber are separated by said common inner wall.

23. The high torque turbine rotor of claim 22, further comprising a first RPM governor in said first annular chamber and a second RPM governor is said second annular chamber.

24. The high torque turbine rotor of claim 23, wherein said first and second RPM governors each comprise:

at least one spiraling wall barrier extending outward from the outer portion of the annular chamber;

a valve o-ring within the annular chamber; and an annular perforated barrier within the annular chamber extending outward from the valve o-ring.

25. The high torque turbine rotor of claim 24, wherein each perforated barrier is integral with the rotor body.

26. The high torque turbine rotor of claim 22, wherein four arcuate chambers radiate from each annular chamber.

27. The high torque turbine rotor of claim 22, further comprising:

a front wall adjacent to the common inner wall; and a back wall adjacent to the common inner wall; wherein the front wall and a front interior surface of the common inner wall are grooved for fitting a first perforated barrier and the back wall and a back interior surface of the common inner wall are grooved for fitting a second perforated barrier.

28. The high torque turbine rotor of claim 24, wherein the valve o-ring is constructed of resilient rubber.

29. The high torque turbine rotor of claim 24, wherein the components, except for the valve o-ring, are constructed of plastic.

30. The high torque turbine rotor of claim 27, wherein the front wall and the back wall are releasably attached to the common inner wall.

31. The high torque turbine rotor of claim 30, wherein the front wall and the back wall are attached to the inner wall by frictional force.

32. The high torque turbine rotor of claim 22, wherein the first plurality of tangential peripheral nozzles are aligned with the second plurality of tangential peripheral nozzles.

* * * * *